US009096088B1

(12) United States Patent
Mochida

(10) Patent No.: US 9,096,088 B1
(45) Date of Patent: Aug. 4, 2015

(54) THERMAL PRINTER AND RIBBON SAVING PROCESSING METHOD

(71) Applicant: TOSHIBA TEC KABUSHIKI KAISHA, Shinagawa-ku, Tokyo (JP)

(72) Inventor: Sadayoshi Mochida, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/521,715

(22) Filed: Oct. 23, 2014

(51) Int. Cl.
*B41J 33/00* (2006.01)
*B41J 33/54* (2006.01)

(52) U.S. Cl.
CPC .. *B41J 33/00* (2013.01); *B41J 33/54* (2013.01)

(58) Field of Classification Search
USPC ..... 347/197, 215, 217
See application file for complete search history.

(56) References Cited

FOREIGN PATENT DOCUMENTS

| | | | | |
|---|---|---|---|---|
| JP | 62-66981 | * | 3/1987 | ..... B41J 33/54 |
| JP | 62-216781 | * | 9/1987 | ..... B41J 33/54 |
| JP | 03-112664 | | 5/1991 | |
| JP | 2003-145817 | | 5/2003 | |
| JP | 2004-174774 | * | 6/2004 | ..... B41J 2/325 |

* cited by examiner

*Primary Examiner* — Huan Tran
(74) *Attorney, Agent, or Firm* — Amin, Turocy & Watson, LLP

(57) ABSTRACT

Generally, in accordance with one embodiment, a thermal printer comprises a ribbon conveyance mechanism, a sheet conveyance mechanism, a thermal head, a thickness sensor, a head moving mechanism and a controller. The ribbon conveyance mechanism conveys a transfer ribbon. The sheet conveyance mechanism conveys a sheet. The thermal head applies heat to the transfer ribbon to transfer ink of the transfer ribbon to the sheet. The thickness sensor detects the thickness of the transfer ribbon. The head moving mechanism heads up the thermal head during the conveyance of the sheet based on the sheet conveyance mechanism. The controller acquires a required non-print area length based on the thickness of the transfer ribbon and a set printing speed, and turns, if there is required non-print area length in printing data, the thermal head into a head-up state and stops the conveyance of the transfer ribbon in the non-print area.

6 Claims, 7 Drawing Sheets

FIG.4

821

| SPEED (mm/s) | THICKNESS (mm) | NON-PRINT AREA LENGTH (mm) |
|---|---|---|
| ⋮ | ⋮ | ⋮ |
| 10 | 0.17 | 58 |
| 12 | 0.10 | 50 |
| 12 | 0.11 | 55 |
| 12 | 0.12 | 60 |
| ⋮ | ⋮ | ⋮ |
| 12 | 0.17 | 80 |
| 14 | 0.10 | 62 |
| ⋮ | ⋮ | ⋮ |

THERMAL PRINTER AND RIBBON SAVING PROCESSING METHOD

FIELD

Embodiments described herein relate to a ribbon saving processing technology of a thermal printer.

BACKGROUND

A thermal printer is known which melts the ink of a transfer ribbon using heat generating elements of a thermal head to transfer the ink to a sheet. The thermal printer conveys the transfer ribbon and the sheet at the same speed while pressing the transfer ribbon against the sheet using the thermal head. In this state, the thermal printer carries out printing on the sheet using the thermal head through the transfer ribbon.

In the thermal printers, there is a thermal printer comprising a ribbon saving mode. In the mode, if a non-print area length in a conveyance direction in the printing data exceeds a given value, the printer stops conveying the transfer ribbon and conveys the sheet merely in the non-print area. Further, the printer heads up the thermal head to separate the thermal head from the sheet, so as to separate the transfer ribbon from the sheet. In this way, in the ribbon saving mode, the consumption amount of the transfer ribbon in the non-print area can be restricted.

The printer heads down the thermal head to return the thermal head to an original printable position, and meanwhile restarts the conveyance of the transfer ribbon before the sheet is conveyed for the length of the non-print area.

By the way, to carry out a ribbon saving processing including the heading up and the heading down, it is necessary that there be non-print area length corresponding to the printing speed (conveyance speed of the sheet) in the printing data. However, the required non-print area length varies for different physical properties of the transfer ribbon for each printing speed. Thus, conventionally, in order to achieve a specific printing quality no matter what kind of transfer ribbon is used, the setting value of the required non-print area length is set as the maximum non-print area length within the non-print area lengths which differ for each physical property.

Thus, there is a problem that the conventional printer cannot carry out the ribbon saving processing if the non-print area length in the printing data is less than the set non-print area length (the maximum non-print area length within the non-print area lengths which vary for different physical properties), even if the non-print area length in the printing data is greater than the required length with respect to the printing speed and the physical property of the transfer ribbon.

BRIEF DESCRIPTION OF THE DRAWINGS

FIG. 4 is a diagram illustrating a table in a ROM;

DETAILED DESCRIPTION

Generally, in accordance with one embodiment, a thermal printer comprises a ribbon conveyance mechanism, a sheet conveyance mechanism, a thermal head, a thickness sensor, a head moving mechanism and a controller. The ribbon conveyance mechanism conveys a transfer ribbon. The sheet conveyance mechanism conveys a sheet. The thermal head applies heat to the transfer ribbon to transfer ink of the transfer ribbon to the sheet. The thickness sensor detects the thickness of the transfer ribbon. The head moving mechanism heads up the thermal head during the conveyance of the sheet based on the sheet conveyance mechanism. The controller acquires a required non-print area length based on the thickness of the transfer ribbon and a set printing speed, and turns, if there is required non-print area length in printing data, the thermal head into a head-up state and stops the conveyance of the transfer ribbon in the non-print area.

The embodiments are described below with reference to the accompanying drawings.

Figure 1:
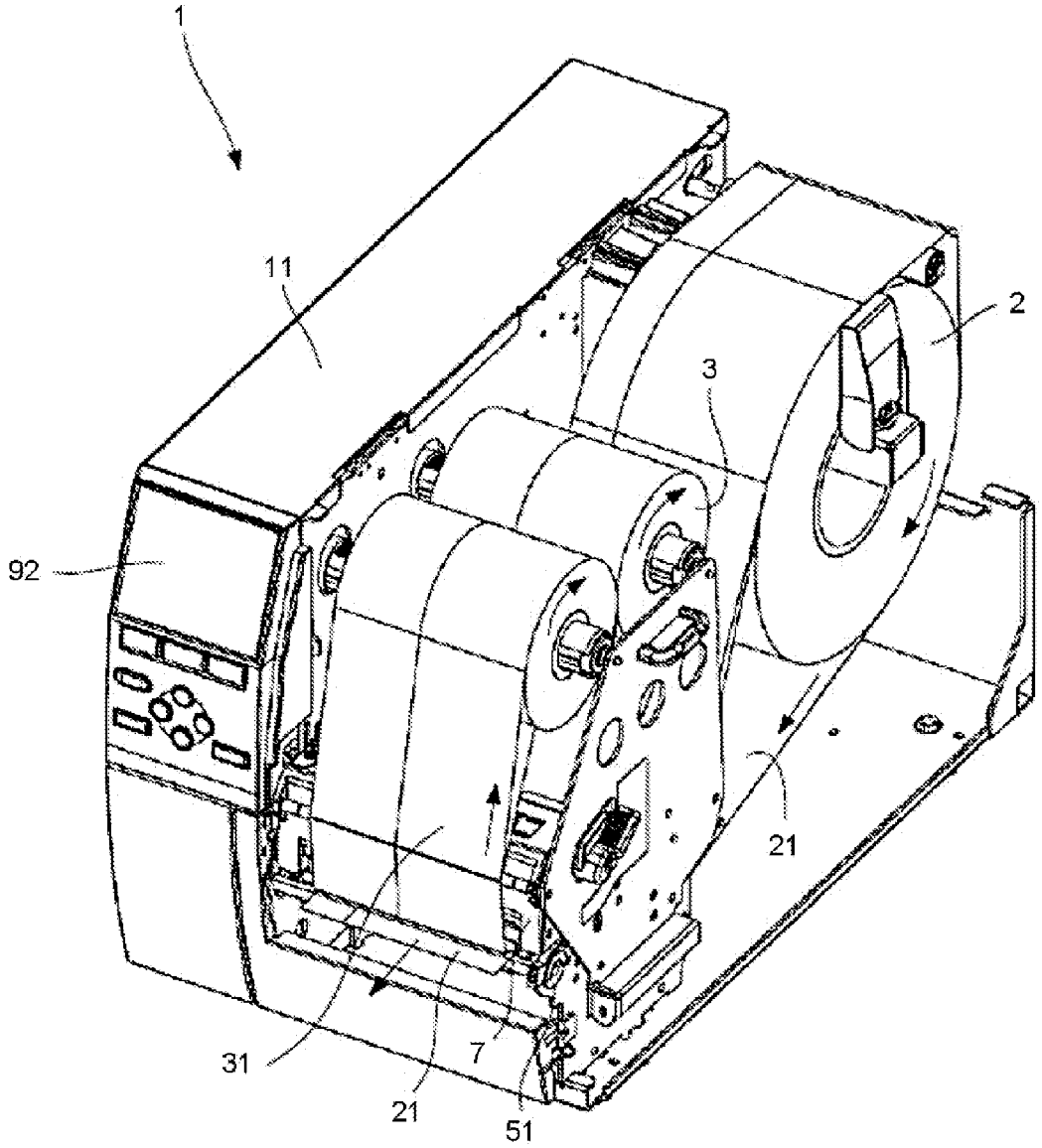
FIG. 1 is an oblique view illustrating the inside of a thermal printer.

FIG. 1 is an oblique view illustrating the inside of a thermal printer 1 (hereinafter recorded as printer 1).

The printer 1 transfers, together with a transfer ribbon 31, a label sheet 21 which is formed by attaching a plurality of labels on a mount between a thermal head 4 (FIG. 2) inside a head moving mechanism 7 and a platen roller 51. The thermal printer 1 prints information on each label of the label sheet 21 using the thermal head 4 through the transfer ribbon 31. The thermal printer 1 prints a commodity name, price, barcode and the like on each label based on the printing data received from an external terminal.

A display 92 is arranged on the front (the nearer side in FIG. 1) of a frame 11 of the printer 1.

A label sheet roll 2 obtained by winding the label sheet 21 and a transfer ribbon roll 3 obtained by winding the transfer ribbon 31 are inside the frame 11 of the printer 1.

Figure 2:
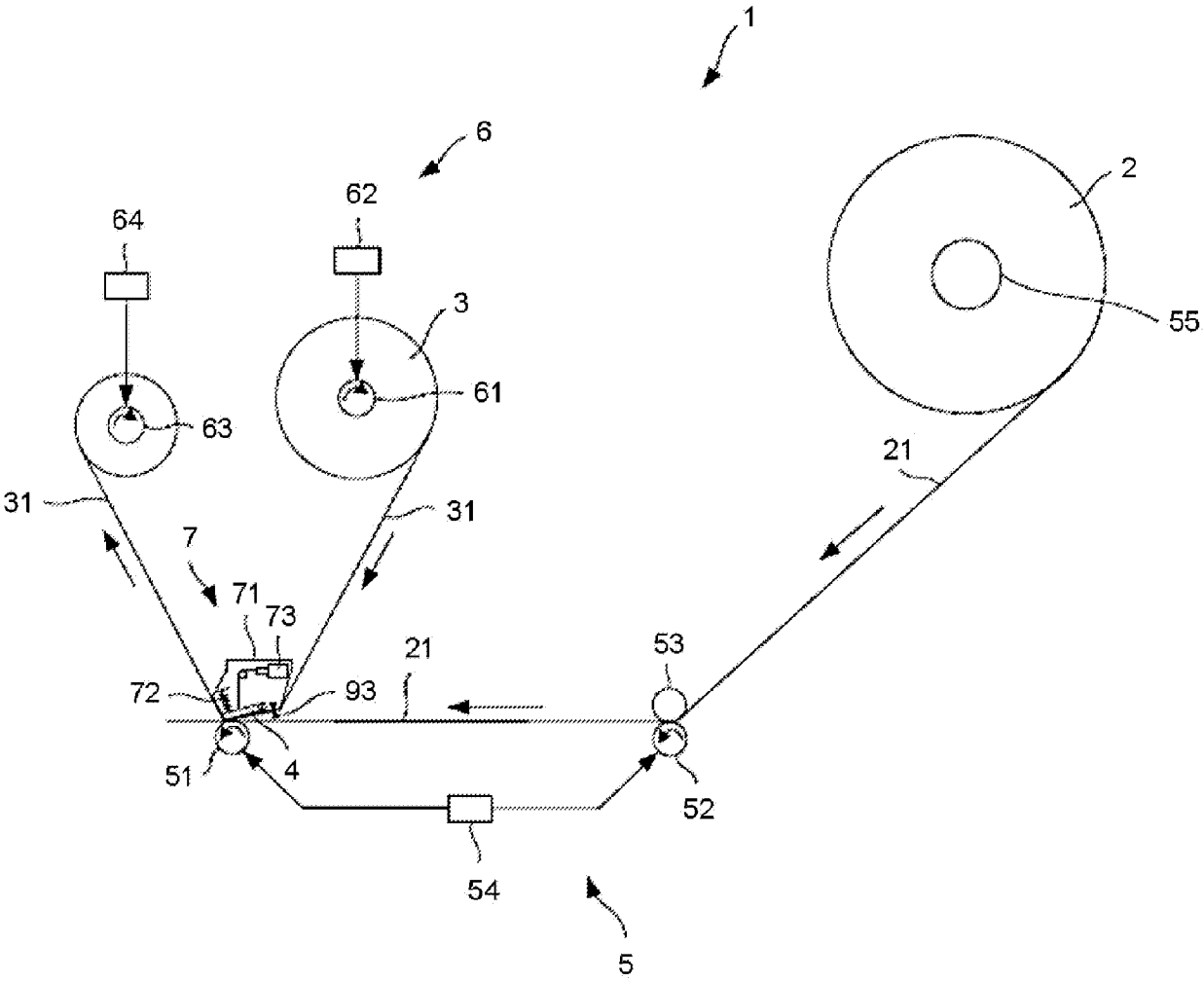
FIG. 2 is a diagram schematically illustrating the internal constitution of the thermal printer.

FIG. 2 is a diagram schematically illustrating the internal constitution of the printer 1.

In addition to the components mentioned above, a sheet conveyance mechanism 5, a ribbon conveyance mechanism 6 and a thickness sensor 93 are also arranged inside the printer 1. Each component of the printer 1 is briefly described below.

The sheet conveyance mechanism 5 conveys the label sheet 21 between the thermal head 4 and the platen roller 51. The sheet conveyance mechanism 5 includes a platen roller 51, a conveyance roller 52, a driven roller 53, a steeping motor 54 and a holding section 55.

The platen roller 51 is arranged opposite to the thermal head 4. In a state shown in FIG. 2 in which the thermal head 4 is made head down to carry out printing, the platen roller 51 conveys the label sheet 21 while clamping the transfer ribbon 31 and the label sheet 21 with the thermal head 4.

The conveyance roller 52 is arranged at the upstream side of the platen roller 51 in a conveyance direction of the label sheet 21 to convey the label sheet 21 towards the downstream side. In a head up-state in which the thermal head 4 retracts upwards and the printing cannot be carried out, the label sheet 21 is mainly conveyed by the conveyance roller 52.

The driven roller 53 clamps the label sheet 21 with the conveyance roller 52, and is driven by the motion of the label sheet 21 to rotate.

The steeping motor 54 drives the platen roller 51 and the conveyance roller 52 through a driving force transmission module such as a belt. A CPU 81 (FIG. 3) described later can know the sheet feed length according to the driving step amount of the steeping motor 54.

The holding section 55 holds the label sheet roll 2 in a rotatable manner.

The ribbon conveyance mechanism 6 conveys the transfer ribbon 31 between the thermal head 4 and the platen roller 51 at a speed equal to the sheet conveyance speed of the sheet conveyance mechanism 5. The ribbon conveyance mechanism 6 is provided with a supply shaft 61, a back ribbon motor 62, a winding shaft 63 and a front ribbon motor 64.

The supply shaft 61 supports the transfer ribbon roll 3. The supply shaft 61 rotates the transfer ribbon roll 3 to supply the transfer ribbon 31 to the space between the thermal head 4 and the platen roller 51.

The back ribbon motor 62 rotates the supply shaft 61.

The winding shaft 63 winds the transfer ribbon 31 passing through the space between the thermal head 4 and the platen roller 51.

The front ribbon motor 64 rotates the winding shaft 63.

The base material of the transfer ribbon 31 is covered with ink.

The thermal head 4 presses the transfer ribbon 31 to the label sheet 21 on the platen roller 51. The thermal head 4 includes, at the lower surface, a plurality of heat generating elements arranged in parallel in a width direction (the direction perpendicular to the paper surface of FIG. 2) of the label sheet 21. The thermal head 4 selectively enables the heat generating elements to generate heat according to an instruction of the CPU 81 in a state of being pressed and contacted with the transfer ribbon 31, so as to apply heat to the transfer ribbon 31 through the heat generating elements. The thermal head 4 melts and sublimates the ink of the transfer ribbon 31 to transfer the ink to the label sheet 21, thereby printing an image on the label sheet 21.

The head moving mechanism 7 heads up the thermal head 4. The "head up" mentioned herein refers to moving the thermal head 4, which is at a printable position (refer to FIG. 2) of pressing the transfer ribbon 31 to the sheet, in an upwards direction in FIG. 2 to separate the thermal head 4 from the platen roller 51, so as to move the thermal head 4 to a print impossible position.

The head moving mechanism 7 heads down the thermal head 4. The "head down" mentioned herein refers to moving the thermal head 4 at the print impossible position in a downwards direction in FIG. 2 to close the thermal head 4 to the platen roller 51, so as to move the thermal head 4 to a printable position.

The head moving mechanism 7 includes a guide frame 71, a spring 72 and a solenoid 73.

The frame 11 (FIG. 1) of the printer 1 holds the guide frame 71.

The guide frame 71 guides the transfer ribbon 31 to the space between the thermal head 4 and the platen roller 51. The guide frame 71 stores the thermal head 4 inside, and holds one end part of the thermal head 4 in a rotatable manner. An opening section is arranged at the lower part of the guide frame 71.

The thermal head 4 is pressed and contacted with the transfer ribbon 31 through the opening section. The guide frame 71 stores the spring 72 inside, and holds one end of the spring 72. The guide frame 71 stores the solenoid 73 inside. The guide frame 71 further holds the thickness sensor 93 which will be described later.

The spring 72 always energizes the other end of the thermal head 4 towards the platen roller 51.

The solenoid 73, if powered on, pulls up the other end of the thermal head 4 against the energization force of the spring 72 to make the thermal head 4 in a head-up state. The solenoid 73, if powered off, releases the pulling of the other end of the thermal head 4 to make the thermal head 4 in a head-down state.

The thickness sensor 93, which is a transmission-type sensor, radiates light to the transfer ribbon 31 and receives the light passing through the transfer ribbon 31 so as to detect the thickness of the transfer ribbon 31.

Figure 3:
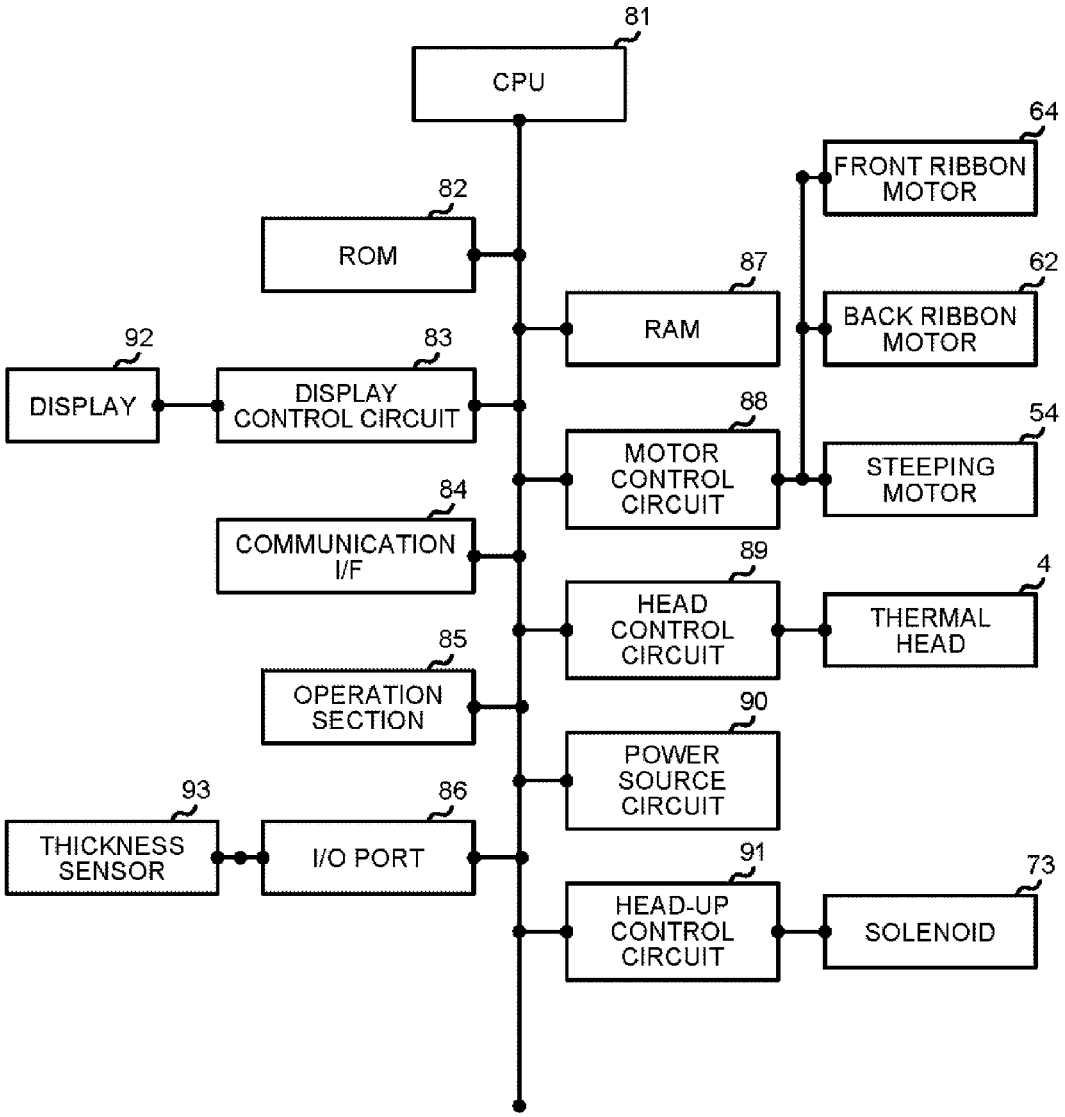
FIG. 3 is a block diagram illustrating the constitution of the thermal printer.

FIG. 3 is a block diagram illustrating the constitution of the printer 1.

The CPU 81 (Central Processing Unit) serving as a controller executes the program stored in a ROM 82 to realize various functions. The ROM 82 (Read Only Memory) stores various control programs. A RAM 87 (Random Access Memory) provides a temporary working area for the CPU 81. A display control circuit 83 controls the display 92 according to the instruction of the CPU 81. A communication I/F 84 receives printing data from an external terminal such as a PC (Personal Computer) and the like connected with the printer 1 through a network. An operation section 85 comprising operation keys and a touch panel receives setting input of, for example, a print start instruction or a printing speed from a user. An I/O port 86 (Input/Output Port) inputs a signal from the thickness sensor 93 to the CPU 81. A motor control circuit 88 controls motors 54, 62 and 64 according to the instruction of the CPU 81. A head control circuit 89 controls the thermal head 4 according to the instruction of the CPU 81. A power source circuit 90 controls the power supply to each component. A head-up control circuit 91 powers on or powers off the solenoid 73 according to the instruction of the CPU 81 to make the thermal head 4 in the head-up state and the head-down state.

The CPU 81 can set the printing speed (conveyance speed of the label sheet 21) to 3, 6, 8, 10, 12 or 14 mm/s. The CPU 81 receives the printing data containing the setting value of the printing speed from the external terminal and then sets the printing speed. The CPU 81 may receive the printing speed setting at the side of the printer 1.

The printer 1 can use the transfer ribbon 31 having a thickness of 0.10-0.17 mm.

FIG. 4 is a diagram illustrating a table 821 in the ROM 82.

As described in the background, in a ribbon saving mode, if there is non-print area length corresponding to the printing speed in the printing data, the ribbon saving processing is carried out. In the ribbon saving processing, during a period when the thermal head 4 passes the non-print area part of the label sheet 21, the thermal head 4 is turned into a head-up state, and the conveyance of the transfer ribbon 31 is stopped. In the processing, the thermal head 4 is turned into a head-down state just before the print area part of the label sheet 21 reaches the position of the thermal head 4. By executing the processing, the consumption of the transfer ribbon 31 in the non-print area part of the label sheet 21 can be restricted.

The ROM 82 stores the table 821 in which each non-print area length required to carry out the ribbon saving processing is associated with each thickness (0.10, 0.11, 0.12 . . . 0.17 mm) of the transfer ribbon 31 and each printing speed (3, 6, 8, 10, 12, 14 mm/s).

Figure 5:
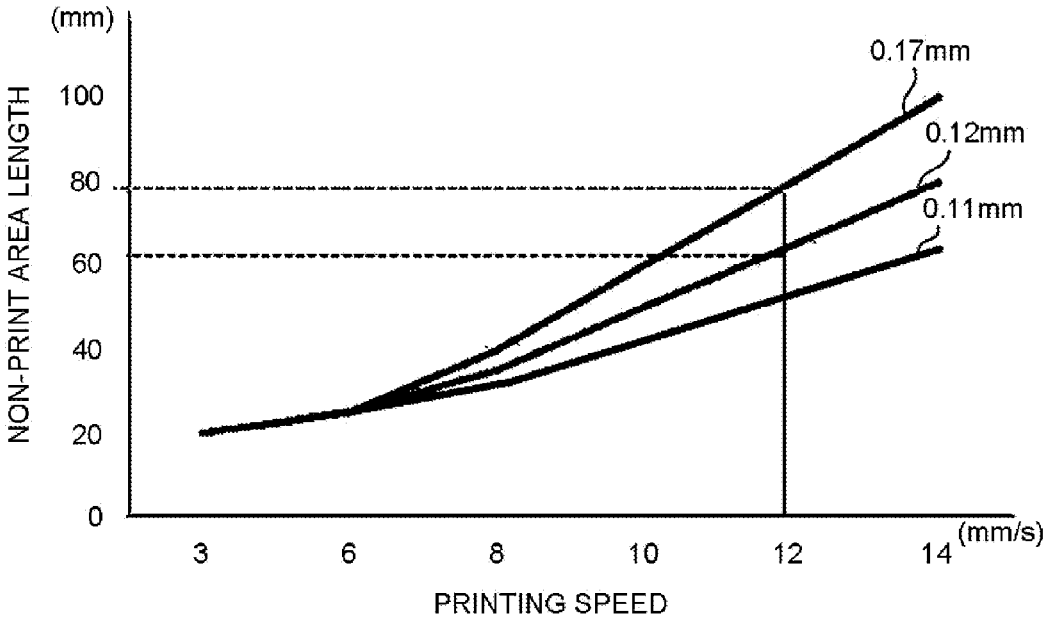
FIG. 5 is a diagram illustrating graphs indicating the relation between a printing speed and a required non-print area length for each thickness of a transfer ribbon.

FIG. 5 is a diagram illustrating graphs indicating the relation between the printing speed and the required non-print area length for each thickness 0.11 mm, 0.12 mm and 0.17 mm of the transfer ribbon 31 in the table 821. The abscissa in FIG. 5 represents the printing speed (mm/s) and the ordinate represents the required non-print area length (mm).

As shown in FIG. 4 and FIG. 5, in the table 821, if the thickness of the transfer ribbon 31 is constant (for example, refer to the graph of the thickness 0.17 mm of the transfer ribbon 31 in FIG. 5), the required non-print area length increases as the printing speed increases. In the table 821, in a case where the thickness of the transfer ribbon 31 is constant (for example, the graph of the thickness 0.17 mm in FIG. 5), the higher the printing speed is, the higher the increase rate of the required non-print area length is. In other words, in the table 821, the slope of the graph of the printing speed-required non-print area length increases as the printing speed increases.

In the table 821, if the printing speed is constant (for example 12 mm/s), the maximum value (for example 80 mm) of the required non-print area length corresponds to the maximum thickness (for example 0.17 mm) as the available thickness of the transfer ribbon 31.

Then, in the table 821, if the printing speed is constant, the required non-print area length decreases as the thickness of the transfer ribbon 31 decreases. For example, in FIG. 4 and FIG. 5, in a case of a speed 12 mm/s, if the thickness of the transfer ribbon 31 is 0.12 mm, the corresponding required non-print area length is 6 mm which is a value smaller than the value (80 mm) of the required non-print area length corresponding to the thickness 0.17 mm of the transfer ribbon 31.

Similarly, in the table 821, in a case of a speed 12 mm/s, if the thickness of the transfer ribbon 31 is 0.11 mm, the corresponding required non-print area length is 55 mm (refer to FIG. 4) which is a value smaller than the value (60 mm) of the required non-print area length corresponding to the thickness 0.12 mm.

Conventionally, to guarantee the printing quality, in a case where the transfer ribbon 31 having the maximum available thickness is used, the ribbon saving processing cannot be carried out if there is no required non-print area length in the printing data.

In the present embodiment, for each printing speed (for example, 12 mm/s) in the table 821, values (for example, 50, 55, 60 mm . . . ) smaller than the value (for example, 80 mm) corresponding to the maximum thickness (for example, 0.17 mm) are associated with the thicknesses (0.10, 0.11, 0.12 . . . 0.16 mm) of each transfer ribbon 31 as the required non-print area lengths.

Thus, in the present embodiment, even though the non-print area length in the printing data is smaller than the maximum thickness of the transfer ribbon 31, the ribbon saving processing can be carried out as long as the length is greater than the value acquired from the table 821. Therefore, compared with the conventional case, the present embodiment can restricts the consumption amount of the transfer ribbon 31.

Figure 6:
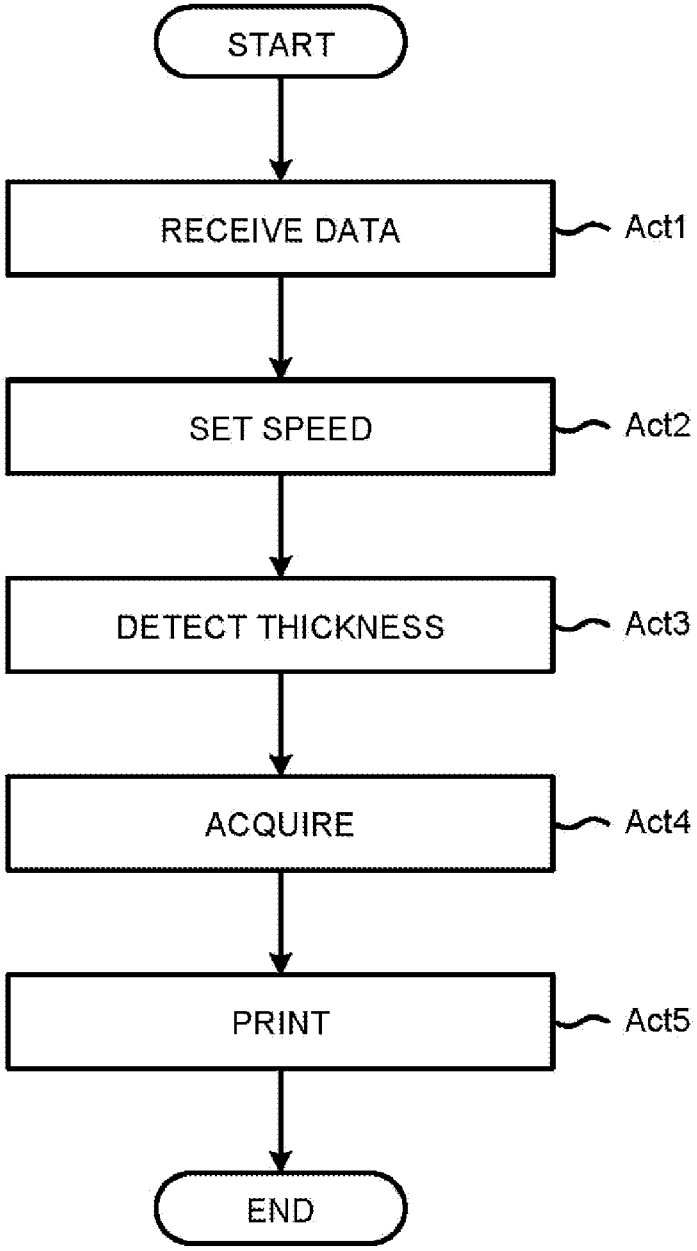
FIG. 6 is a flowchart illustrating a ribbon saving processing carried out by a CPU.

Hereinafter, the processing carried out in the ribbon saving mode by the CPU 81 is briefly described with reference to the flowchart shown in FIG. 6.

The CPU 81 receives the printing data from the external terminal (ACT 1).

The CPU 81 sets the printing speed to the instructed value of the printing speed contained in the printing data (ACT 2). In addition, the CPU 81 may also set the printing speed to the printing speed received by the printer 1.

The CPU 81 detects the thickness of the transfer ribbon 31 using the thickness sensor 93 (ACT 3).

The CPU 81 acquires, based on the thickness of the transfer ribbon 31 and the set printing speed, the non-print area length in the printing data required to carry out the ribbon saving processing from the table 821 in the ROM 82 (ACT 4).

Figure 7:
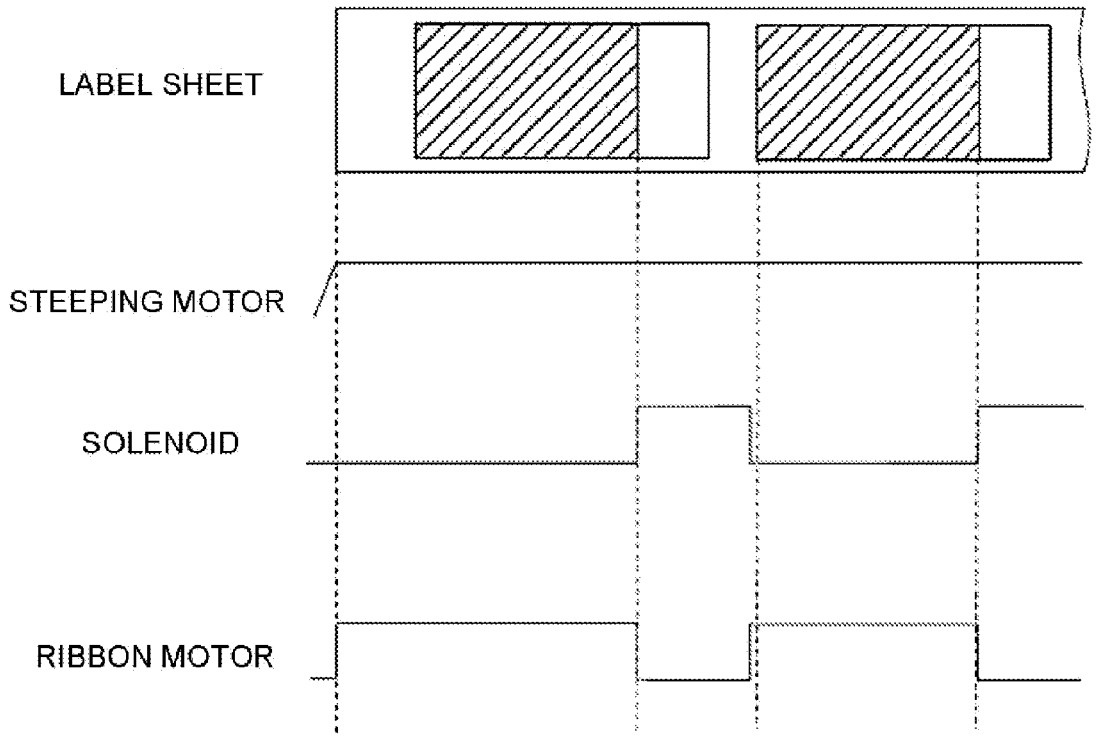
FIG. 7 is a diagram illustrating the timing waveform of each component in printing processing.

FIG. 7 is a diagram illustrating the timing waveform of each component in printing processing.

The CPU 81 carries out printing on the label sheet 21 based on the printing data (ACT 5).

Specifically, the CPU 81 conveys the label sheet 21 and the transfer ribbon 31 at the printing speed set in ACT 2. If the front end of the print area part of the label sheet 21 reaches the printing position of the thermal head 4, the CPU 81 carries out printing on the label sheet 21 using the thermal head 4 through the transfer ribbon 31.

The CPU 81 determines the timing based on the driving step amount of the steeping motor. The CPU 81 powers off the solenoid 73 in the general printing processing stated above and in a printing standby mode, so as to maintain the thermal head 4 in the head-down state.

For example, if the printing of the print area part is completed, and the front end of the non-print area part of the label sheet 21 reaches the printing position of the thermal head 4, the CPU 81 carries out the ribbon saving processing if the non-print area length is greater than the required non-print area length acquired in ACT 4.

That is, the CPU 81 powers on the solenoid 73 to maintain the thermal head 4 in the head-upstate. Further, the CPU 81 stops the driving of the ribbon motors 62 and 64 to stop the conveyance of the transfer ribbon 31.

The CPU 81 powers off the solenoid 73 again just before the front end of the print area part of the label sheet 21 reaches the printing position of the thermal head 4, so as to maintain the thermal head 4 in the head-down state. Further, the CPU 81 drives the ribbon motors 62 and 64 to restart the conveyance of the transfer ribbon 31.

If the non-print area length is smaller than the required non-print area length acquired in ACT 4, the CPU 81 does not carry out the ribbon saving processing and maintains the thermal head 4 in the head-down state even when the front end of the non-print area part of the label sheet 21 reaches the printing position of the thermal head 4.

The order of each processing in the embodiment described above may be different from the order exemplified in the embodiment described above.

As stated above in detail, in accordance with the technology described herein, a ribbon saving processing technology of a thermal printer is provided.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A thermal printer, comprising:

a ribbon conveyance mechanism configured to convey a transfer ribbon;

a sheet conveyance mechanism configured to convey a sheet;

a thermal head configured to apply heat to the transfer ribbon to transfer ink of the transfer ribbon to the sheet;

a thickness sensor configured to detect the thickness of the transfer ribbon;

a head moving mechanism configured to head up the thermal head during the conveyance of the sheet based on the sheet conveyance mechanism; and a controller configured to acquire a required non-print area length based on the thickness of the transfer ribbon and a set printing speed, and turn, if there is the required non-print area length in printing data, the thermal head into a head-up state and stop the conveyance of the transfer ribbon in the non-print area.

2. The thermal printer according to claim 1, comprising:

a memory configured to store a table in which each required non-print area length is associated with each thickness of the transfer ribbon and each printing speed; wherein a value smaller than a value corresponding to the maximum thickness of the transfer ribbon is associated with the thickness of each transfer ribbon as the required non-print area length for each printing speed in the table, and the controller acquires the required non-print area length from the table based on the thickness of the transfer ribbon and the set printing speed.

3. The thermal printer according to claim 2, wherein in the table, the higher the printing speed is, the higher the increase rate of the required non-print area length is.

4. A ribbon saving processing method, including:

acquiring printing data;

setting printing speed;

detecting the thickness of the transfer ribbon through the thickness sensor;

acquiring a required non-print area length based on the thickness of the transfer ribbon and the printing speed; and turning, if there is the required non-print area length in the printing data, the thermal head into a head-up state and stopping the conveyance of the transfer ribbon in the non-print area.

5. The ribbon saving processing method according to claim 4, further including:

storing a table in which each required non-print area length is associated with each thickness of the transfer ribbon and each printing speed;

associating a value smaller than a value corresponding to the maximum thickness of the transfer ribbon with the thickness of each transfer ribbon as the required non-print area length for each printing speed in the table; and acquiring the required non-print area length from the table based on the thickness of the transfer ribbon and the set printing speed.

6. The ribbon saving processing method according to claim 5, wherein the table is stored in which the higher the printing speed is, the higher the increase rate of the required non-print area length is.

* * * * *